US011848023B2

(12) United States Patent
Rudberg et al.

(10) Patent No.: US 11,848,023 B2
(45) Date of Patent: Dec. 19, 2023

(54) AUDIO NOISE REDUCTION

(71) Applicant: Google LLC, Mountain View, CA (US)

(72) Inventors: Tore Rudberg, Stockholm (SE); Marcus Wirebrand, Huddinge (SE); Samuel Sonning, Stockholm (SE); Christian Schuldt, Stockholm (SE)

(73) Assignee: Google LLC, Mountain View, CA (US)

( * ) Notice: Subject to any disclaimer, the term of this patent is extended or adjusted under 35 U.S.C. 154(b) by 161 days.

(21) Appl. No.: 16/896,685

(22) Filed: Jun. 9, 2020

(65) Prior Publication Data

US 2020/0388297 A1 Dec. 10, 2020

Related U.S. Application Data

(60) Provisional application No. 62/859,327, filed on Jun. 10, 2019.

(51) Int. Cl.
*G10L 21/0208* (2013.01)
*G10L 25/84* (2013.01)

(52) U.S. Cl.
CPC ..... *G10L 21/0208* (2013.01); *G10L 25/84* (2013.01)

(58) Field of Classification Search
CPC ..... G10L 21/0208; G10L 25/84
See application file for complete search history.

(56) References Cited

U.S. PATENT DOCUMENTS 9,640,194 B1 5/2017 Nemala et al.
9,978,374 B2 * 5/2018 Heigold ..... G10L 17/02
10,148,868 B2 * 12/2018 Oyman ..... G06V 10/40
2003/0117967 A1 * 6/2003 Tahernezhaadi ..... H04B 3/23 370/286
2005/0129226 A1 6/2005 Piket et al.
2012/0259631 A1 * 10/2012 Lloyd ..... G10L 15/20 704/E15.039

(Continued)

OTHER PUBLICATIONS

Yoshioka et al., "Multi-Microphone Neural Speech Separation for Far-Field Multi-Talker Speech Recognition," 2018 IEEE International Conference on Acoustics, Speech and Signal Processing (ICASSP), 2018, pp. 5739-5743, doi: 10.1109/ICASSP.2018.8462081 (Year: 2018).*

(Continued)

*Primary Examiner* — Michelle M Koeth
(74) *Attorney, Agent, or Firm* — Fish & Richardson P.C.

(57) ABSTRACT

Methods, systems, and apparatus, including computer programs encoded on a computer storage medium, for reducing audio noise are disclosed. In one aspect, a method includes the actions of receiving first audio data of a user utterance. The actions further include determining an energy level of second audio data being outputted by the loudspeaker. The actions further include selecting a model from among (i) a first model that is trained using first audio data samples that each encode speech from one speaker and (ii) a second model that is trained using second audio data samples that each encode speech from either one speaker or two speakers. The actions further include providing the first audio data as an input to the selected model. The actions further include receiving processed first audio data. The actions further include outputting the processed first audio data.

20 Claims, 4 Drawing Sheets

(56) References Cited

U.S. PATENT DOCUMENTS

2014/0278397 A1* 9/2014 Chen ..... G10L 21/02
704/233
2019/0172476 A1* 6/2019 Wung ..... G10L 21/0232

OTHER PUBLICATIONS

Yashioka et al., "Recognizing Overlapped Speech in Meetings: A Multichannel Separation Approach Using Neural Networks," Interspeech 2018, Sep. 6, 2018, Hyderabad, India. (Year: 2018).*
European Extended Search Report in European Application No. 20179147.2, dated Nov. 4, 2020, 10 pages.
Nugraha, "Deep neural networks for source separation and noise-robust speech recognition" Signal and Image Processing, 2018, 201 pages.

* cited by examiner

AUDIO NOISE REDUCTION

CROSS-REFERENCE TO RELATED APPLICATION

This application claims the benefit of U.S. Application 62/859,327, filed Jun. 10, 2019, which is incorporated by reference.

TECHNICAL FIELD

This specification generally relates to speech processing.

BACKGROUND

Speech processing is the study of speech signals and the processing methods of signals. The signals are usually processed in a digital representation, so speech processing can be regarded as a special case of digital signal processing, applied to speech signals. Aspects of speech processing includes the acquisition, manipulation, storage, transfer and output of speech signals.

SUMMARY

Conducting an audio conference can sometimes be challenging for audio conference systems. The audio conference systems may have to perform multiple audio signal processing techniques including linear acoustic echo cancellation, residual echo suppression, noise reduction, etc. Some of these signal processing techniques may perform well when a speaker is speaking and there is no speech being output by a loudspeaker of the audio conference system, but these signal processing techniques may perform poorly when the microphone of the audio conference system is picking up speech from a nearby speaker as well as speech being output by the loudspeaker.

To process audio data that may include both speech from a nearby speaker and speech being output by the loudspeaker, it may be helpful to train different audio processing models. One model may be configured to reduce noise in audio data that includes speech from one speaker, and another model may be configured to reduce noise in audio data that includes speech from more than one speaker. The audio conference system may select one of the models depending on the energy level of audio being output by the loudspeaker. If the audio being output by the loudspeaker is above a threshold energy level, then the audio conference system may select the model trained with audio samples that include one speaker. If the audio being output by the loudspeaker is below the threshold energy level, then the audio conference system may select the model trained with audio samples from both a single speaker and two speakers.

According to an innovative aspect of the subject matter described in this application, a method for reducing audio noise includes the actions of receiving, by a computing device that has an associated microphone and loudspeaker, first audio data of a user utterance, the first audio data being generated using the microphone; while receiving the first audio data of the user utterance, determining, by the computing device, an energy level of second audio data being outputted by the loudspeaker of the computing device; based on the energy level of the second audio data, selecting, by the computing device a model from among (i) a first model that is configured to reduce noise in audio data and that is trained using first audio data samples that each encode speech from one speaker and (ii) a second model that is configured to reduce noise in the audio data and that is trained using second audio data samples that each encode speech from either one speaker or two speakers; providing, by the computing device, the first audio data as an input to the selected model; receiving, by the computing device and from the selected model, processed first audio data; and providing, for output by the computing device, the processed first audio.

These and other implementations can each optionally include one or more of the following features. The actions further include receiving, by the computing device, audio data of a first utterance spoken by a first speaker and audio data of a second utterance spoken by a second speaker; generating, by the computing device, combined audio data by combining the audio data of the first utterance and the audio data of the second utterance; generating, by the computing device, noisy audio data by combining the combined audio data with noise; and training, by the computing device and using machine learning, the second model using the combined audio data and the noisy audio data. The action of combining the audio data of the first utterance and the audio data of the second utterance includes overlapping the audio data of the first utterance and the audio data of the second utterance in the time domain and summing the audio data of the first utterance and the audio data of the second utterance.

The actions further include, before providing the first audio data as an input to the selected model, providing, by the computing device, the first audio data as an input to an echo canceller that is configured to reduce echo in the first audio data. The actions further include receiving, by the computing device, audio data of an utterance spoken by a speaker; generating, by the computing device, noisy audio data by combining the audio data of the utterance with noise; and training, by the computing device and using machine learning, the first model using the audio data of the utterance and the noisy audio data. The second model is trained using second audio data samples that each encode speech from either two simultaneous speakers or one speaker. The actions further include comparing, by the computing device, the energy level of the second audio data to a threshold energy level; and, based on comparing the energy level of the second audio data to the threshold energy level, determining, by the computing device, that the energy level of the audio data does not satisfy the threshold energy level.

The action of selecting the model includes selecting the second model based on determining that the energy level of the second audio data does not satisfy the threshold energy level. The action of comparing, by the computing device, the energy level of the second audio data to a threshold energy level; and, based on comparing the energy level of the second audio data to the threshold energy level, determining, by the computing device, that the energy level of the audio data satisfies the threshold energy level. The action of selecting the model includes selecting the first model based on determining that the energy level of the second audio data satisfies the threshold energy level. The microphone of the computing device is configured to detect audio output by the loudspeaker of the computing device. The computing device is communicating with another computing device during an audio conference.

Other implementations of this aspect include corresponding systems, apparatus, and computer programs recorded on computer storage devices, each configured to perform the operations of the methods.

Particular implementations of the subject matter described in this specification can be implemented so as to realize one or more of the following advantages. Participants in an audio conference system may clearly hear speakers on another end of the audio conference even if more than one speakers are speaking at the same time.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

According to implementations described herein, there are provided methods, systems, and apparatus, including computer programs encoded on a computer storage medium, for reducing audio noise. In some implementations, a method includes the actions of receiving first audio data of a user utterance, for example, audio data generated using a microphone. The actions further include determining an energy level of second audio data being outputted by the loudspeaker. The actions further include selecting a model from among (i) a first model that is trained using first audio data samples that each encode speech from one speaker and (ii) a second model that is trained using second audio data samples that each encode speech from either one speaker or two speakers. The actions further include providing the first audio data as an input to the selected model. The actions further include receiving processed first audio data. The actions further include outputting the processed first audio data.

Figure 1:
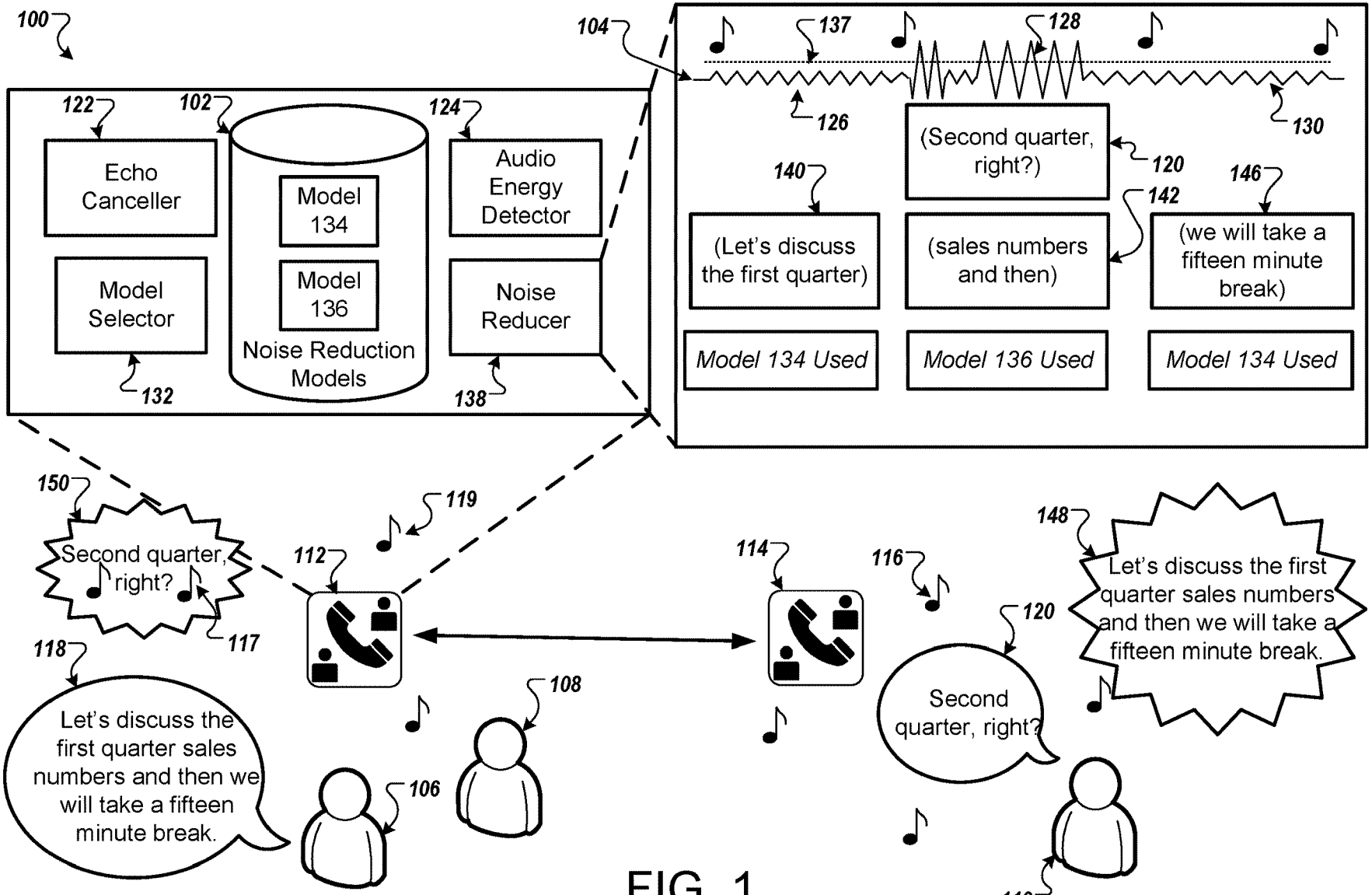
FIG. 1 illustrates an example audio conference system that applies different noise reduction models to audio data generated from audio picked up by a microphone depending on audio output by a loudspeaker.

FIG. 1 illustrates an example audio conference system 100 that applies different noise reduction models 102 to the audio data generated from audio detected by the microphone, depending on the energy level of audio 104 that is output by a loudspeaker of the device detecting the utterance 118. Briefly, and as described in more detail below, the audio conference device 112 and the audio conference device 114 are communicating in an audio conference. The audio conference device 112 and the audio conference device 114 are configured process audio detected by each microphone by applying different noise reduction models depending on the energy level of audio being output by a corresponding loudspeaker of the audio conference device 112 and the audio conference device 114.

The audio conference device 112 can have an associated microphone and an associated loudspeaker, both of which are used during a conference. In some implementations, the microphone and/or loudspeaker may be included in the same housing as other components of the audio conference device 112. In some implementations, the microphone and/or loudspeaker of the audio conference device 112 may be peripheral devices or connected devices, e.g., separate devices connected through a wired interface, a wireless interface, etc. The audio conference device 114 similarly has its own associated microphone and associated loudspeaker.

In more detail, the user 106, the user 108, and the user 110 are participating in an audio conference using the audio conference device 112 and the audio conference device 114. The audio conference device 112 and the audio conference device 114 may be any type of device that is capable of detecting audio and receiving audio from another audio conference device over a network. For example, the audio conference device 112 and the audio conference device 114 may each be one or more of a phone, a conference speaker phone, a laptop computer, a tablet computer, or other similar device.

In the example, the user 106 and the user 108 are in the same room with the audio conference device 112, and the user 110 is in the same room with the audio conference device 114. There is background noise 116 in the room with the audio conference device 114. The audio conference device 114 may also transmit some of the background noise 116 that that audio conference device 112 detects as background noise 117 and that is included in the audio that encodes utterance 150. There may also be additional background noise 119 that is in the room where the audio conference device 112 is located and that is detected by the microphone audio conference device 112. The background noise 116 and 119 may be music, street noise, noise from an air vent, muffled talking in a neighboring office, etc. The audio conference device 114 may detect the background noise 116 in addition to the utterance 120.

When the audio conference device 112 outputs the audio that encodes the utterance 150 through the loudspeaker, the microphone of the audio conference device 112 detects the utterance 150, the background noise 117, and the background noise 119. Using the techniques described below, the audio conference device 112 may be able to reduce the noise detected by the microphone while the user 106 is speaking the utterance 118, before the audio conference device 112 transmits the audio data of the utterance 118 to the audio conference device 114. A loudspeaker may refer to a component of a computing device or other electronic device that outputs audio in response to input from the computing device or the other electronic device. For example, a loudspeaker may be an electroacoustic transducer that converts an electrical audio signal into sound, By contrast, speaker may refer to a person or user who is speaking, has spoken, or is capable of speaking.

In the example of FIG. 1, the user 106 speaks the utterance 118 by saying, "Let's discuss the first quarter sales numbers and then we will take a fifteen minute break." While the user 106 is talking, the user 110 says utterance 120 simultaneously by saying, "Second quarter, right?" The user 110 may say utterance 120 at the same time user 106 is saying "sales numbers and then." The audio conference device 112 detects the utterance 118 through a microphone or another audio input device and processes the audio data using an audio subsystem.

The audio subsystem may include the microphone, other microphones, an analog-to-digital converter, a buffer, and various other audio filters. The microphones may be configured to detect sounds in the surrounding area such as speech, e.g., the utterance 118, and generate respective audio data. The analog-to-digital converter may be configured to sample the audio data generated by the microphone. The buffer may store the sampled audio data for processing by the audio conference device 112 and/or for transmission by the audio conference device 112. In some implementations, the audio subsystem may be continuously active or may be active during times when the audio conference device 112 is expecting to receive audio such as during a conference call. In this case, the microphone may detect audio in response to the initiation of the conference call with the audio conference device 114. The analog-to-digital converter may be constantly sampling the detected audio data during the conference call. The buffer may store the latest sampled audio data such as the last ten seconds of sound. The audio subsystem may provide the sampled and filtered audio data of the utterance 118 to another component of the audio conference device 112.

In some implementations, the audio conference device 112 may process the sampled and filtered audio data using an echo canceller 122. The echo canceller 122 may implement echo suppression and/or echo cancellation. The echo canceller 112 may include an adaptive filter that is configured to estimate the echo and subtract the estimated echo from the sampled and filtered audio data. The echo canceller 112 may also include a residual echo suppressor that is configured to remove any residual echo that is not removed by subtracting the echo estimated by the adaptive filter. The audio conference device 112 may process the sampled and filtered audio data using an echo canceller 122 before providing the sampled and filtered audio data as an input to the model 134 or the model 136. As an example, the microphone of audio conference device 112 may detect audio of utterance 118 and audio output by the loudspeaker of the audio conference device 112. The echo canceller 122 may subtract the audio output by the loudspeaker from the audio detected by the microphone. This may remove some echo, but may not remove all of the echo and noise.

In some implementations, the audio energy detector 124 receives the audio data 104 that is used to produce output by the loudspeaker of the audio conference device 112. The audio data 104 encodes the noise 117 and the utterance 150. In some implementations, the audio data 104 is audio data received from the conference system 114. For example, the audio data 104 can be audio data, received over a network, that describes audio to be reproduced by the loudspeaker as part of the conference. In some implementations, the audio data 104 can be generated or measured based on sensing audio actually output by a loudspeaker of the audio conference device 112. The audio energy detector 124 is configured to measure the energy of the audio data 104 that is output by the loudspeaker of the audio conference device 112. The energy may be similar to the amplitude or power of the audio data. The audio energy detector 124 may be configured to measure the energy at periodic intervals such as every one hundred milliseconds. In some implementations, the audio energy detector 124 may measure the energy more frequently in instances where a voice activity detector indicates that the audio data, either generated by the microphone or used to generate audio output by the loudspeaker, includes speech than when the voice activity detector indicates that the audio data does not include speech. In some implementations, the audio energy detector 124 averages the energy of the audio data 104 output by the loudspeaker over a time period. For example, the audio energy detector 124 may average the energy of the audio data over one hundred milliseconds. The averaging period may change for reasons similar to the measurement frequency changing.

In the example of FIG. 1, the audio energy detector 124 determines that the energy of a first audio portion 126 is forty-two decibels, the energy of a second audio portion 128 is sixty-seven decibels, and the energy of a third audio portion 130 is forty-one decibels.

The audio energy detector 124 provides the energy measurements to the model selector 132. The model selector 132 is configured to select a noise reduction model, from among the set of noise reduction models 102 (e.g., model 134 and model 136), based on the energy measurements received from the audio energy detector 124. The model selector 132 may compare the energy measurement to an energy threshold 137. If the energy measurement is above the energy threshold 137, then the model selector 132 selects the noise reduction model 136. If the energy measurement is below the energy threshold 137, then the model selector 132 selects the noise reduction model 134. The data used to train the noise reduction model 134 and the noise reduction model 136 will be discussed below in relation to FIG. 2.

In some implementations, instead of the energy threshold 137, the model selector 132 may compare the energy measurement to a series of ranges. If the energy measurement is within a particular range, then the model selector 132 selects the noise reduction model that corresponds to that range. If the energy measurement changes to another range, then the model selector 132 selects a different noise reduction model.

By selectively using different noise reduction models 102 depending on the conditions during the conference, the audio conferencing device 112 can provide higher quality audio and adapt to different situations occurring during the conference. In the example, applying the audio energy threshold 137 helps the audio conferencing device 112 identify when one or more other conference participants (e.g., at a remote location using the conferencing device 114) are speaking. The audio conferencing device 112 then selects which of the models 134, 136 is used based on whether the speech energy in audio data from other conferencing devices satisfies the audio energy threshold 137. This can be particularly useful to identify "double-talk" conditions, in which people at different conference locations (e.g., using different devices 112, 114) are talking simultaneously. The noise and echo considerations can be quite different in double-talk conditions compared to other situations when, for example, speech is being provided at one conference location. The audio conference device 112, and the audio conference device 114, can detect the double-talk situation and apply a different noise reduction model for the duration of that condition (e.g., during portion 128). The audio conference device 112 can then select and apply one or more other noise reduction models when different conditions are detected.

The noise reducer 138 uses the selected noise reduction model to reduce the noise in the audio data generated using the microphone of the audio conference device 112 and processed by the audio subsystem of the audio conference device 112 and, in some instances, the echo canceller 122 of the audio conference device 112. The noise reducer 138 may continuously provide the audio data as an input to the selected noise reduction model and switch to providing the audio data as an input to a different noise reduction model as indicated by the model selector 132. For example, the noise reducer 138 may provide the audio portion that encodes the utterance portion 140 and any other audio detected by the microphone as an input to the model 134. The audio portion encodes the audio corresponding to the utterance portion 140 where the user 106 said, "Let's discuss the first quarter." The audio conference device 112 may transmit the output from the model 134 to the audio conference device 114. The audio conference device 114 may output a portion of the audio 148 through a loudspeaker of the audio conference device 114. For example, the user 110 hears the user 106 speaking, "Let's discuss the first quarter."

The noise reducer 138 may continue to provide the audio data that is generated by the microphone of and processed by the audio conference device 112 to the selected model. The audio data may be processed by the audio subsystem of the audio conference device 112 and, in some instances, the echo canceller 122 of the audio conference device 112. For example, the noise reducer 138 may provide the audio portion that encodes the utterance portion 142 as an input to model 136. The audio portion encodes the utterance portion 142 where the user 106 said, "sales numbers and then. The audio conference device 112 may transmit the output from the model 136 to the audio conference device 114. The audio conference device 114 may output another portion of the audio 148 through the loudspeaker of the audio conference device 114. For example, the user 110 hears the user 106 speaking, "sales numbers then" and at the same time the user 110 says, "Second quarter, right?"

The noise reducer 138 may continue to provide the audio data detected by the microphone of and processed by the audio conference device 112 to the selected model. The audio data may be processed by the audio subsystem of the audio conference device 112 and, in some instances, the echo canceller 122 of the audio conference device 112. For example, the noise reducer 138 may provide the audio portion that includes the utterance portion 146 as an input to the model 134. The audio portion encodes the utterance portion 146 where the user 106 said, "we will take a fifteen minute break." The audio conference device 112 may transmit the output from the model 134 to the audio conference device 114. The audio conference device 114 may output a portion of the audio 148 through the loudspeaker of the audio conference device 114. For example, the user 110 hears the user 106 speaking, "we will take a fifteen minute break."

In some implementations, the noise reducer 138 may provide audio data representing audio picked up by the microphone as an input to the selected model by continuously providing audio frames of the audio data to the selected model. For example, the noise reducer 138 may receive a frame of audio data that includes a portion of the utterance 118 and audio output by the loudspeaker. The noise reducer 138 may provide the frame of audio data to the model 134. The model 134 may process the frame of audio data or may process a group of frames of audio data. The noise reducer 138 may continue to provide frames of audio data to the selected model until the model selector 132 indicates to change to provide frames of the audio data to a different model. The different model may receive the frames of the audio data, process the frames, and output the processed audio data.

The audio conference device 112 may use different noise models to improve audio quality. If the audio of the loudspeaker of the audio conference device 112 is below a threshold, then the audio conference device 112 uses the model trained using audio data from both one speaker and two speakers. In this case, the audio conference device 112 should be able to process and output speech from both user 106 and user 108 either speaking individually or simultaneously. If the audio of the loudspeaker of the audio conference device 112 is above a threshold, then the audio conference device 112 uses the model trained using audio data from one speaker to remove echo that is detected by the microphone of the audio conference device 112. This model selection may impact the situation where both user 106 and user 108 are speaking simultaneously while the loudspeaker is active (e.g., because user 110 is speaking). However, that situation is similar to having three people speaking at the same time, and there may not be a significant degradation in audio quality to use the single speaker model. The single speaker model may enhance audio from only one speaker, but also remove the echo from the loudspeaker.

In general, conferencing systems (e.g., audio conferencing systems, video conferencing systems, etc.) perform multiple audio signal processing operations, such as linear acoustic echo cancellation, residual echo suppression, noise reduction, comfort noise etc. Generally, the linear acoustic echo canceller removes echo through subtraction and does not distort the near-end speech. The linear acoustic echo canceller can remove a substantial amount of echo, but it does not remove all of the echo in all circumstances, e.g., due to distortion, nonlinearities etc. As a result, there is a need for residual echo suppression that can remove the residual echo not removed by a linear acoustic echo canceller, although this has the potential downside of distorting possible near-end speech, if present at the same time as the residual echo. Designing a residual echo suppressor often involves a trade-off between transparency (e.g., duplex) and echo suppression.

To improve audio quality, the audio conference device 112 can select differently trained models (e.g., machine-learning-trained echo or noise reduction models) depending on the situation or conditions present during a conference. As discussed above, the selection can be made based on properties of audio data received, such as the audio energy level. As another example, different models can be selected depending on whether the residual echo suppression is actively working (e.g., damping away echo) or not. Similarly, different models can be selected based on the number participants currently talking, whether there people speaking simultaneously are in the same location or in different locations, whether there is echo detected, or based on other conditions.

As an example, there may be two noise reduction models configured for different numbers of people talking simultaneously in the same meeting room, for example, with a first model trained for one person talking at a time, and a second model trained using example data in which two or more people talk simultaneously at the same location. In some cases, a single-speaker noise reduction model, trained only with examples of one person speaking at a time, may not provide desired results in the case of multiple simultaneous people speaking, which can be a common scenario in a real conference. As a result, the option of a model trained for multiple people talking simultaneously at the same location can improve performance if it is selected when the corresponding situation occurs. Nevertheless, a single-speaker noise reduction model can help mitigate echo during double-talk (e.g., people at different locations talking simultaneously), perhaps at least in part due to the fact that the single-speaker noise reduction model is prone to focus on one speaker. Hence, it can be beneficial to have the model for two or more simultaneous talkers (e.g., model 134) running when there is speech at only one conference location (e.g., when there is little or no echo), and have the single-speaker model (e.g., model 136) running when double-talk is occurring or at least when audio data received from another conference location has at least a threshold amount of speech energy.

Figure 2:
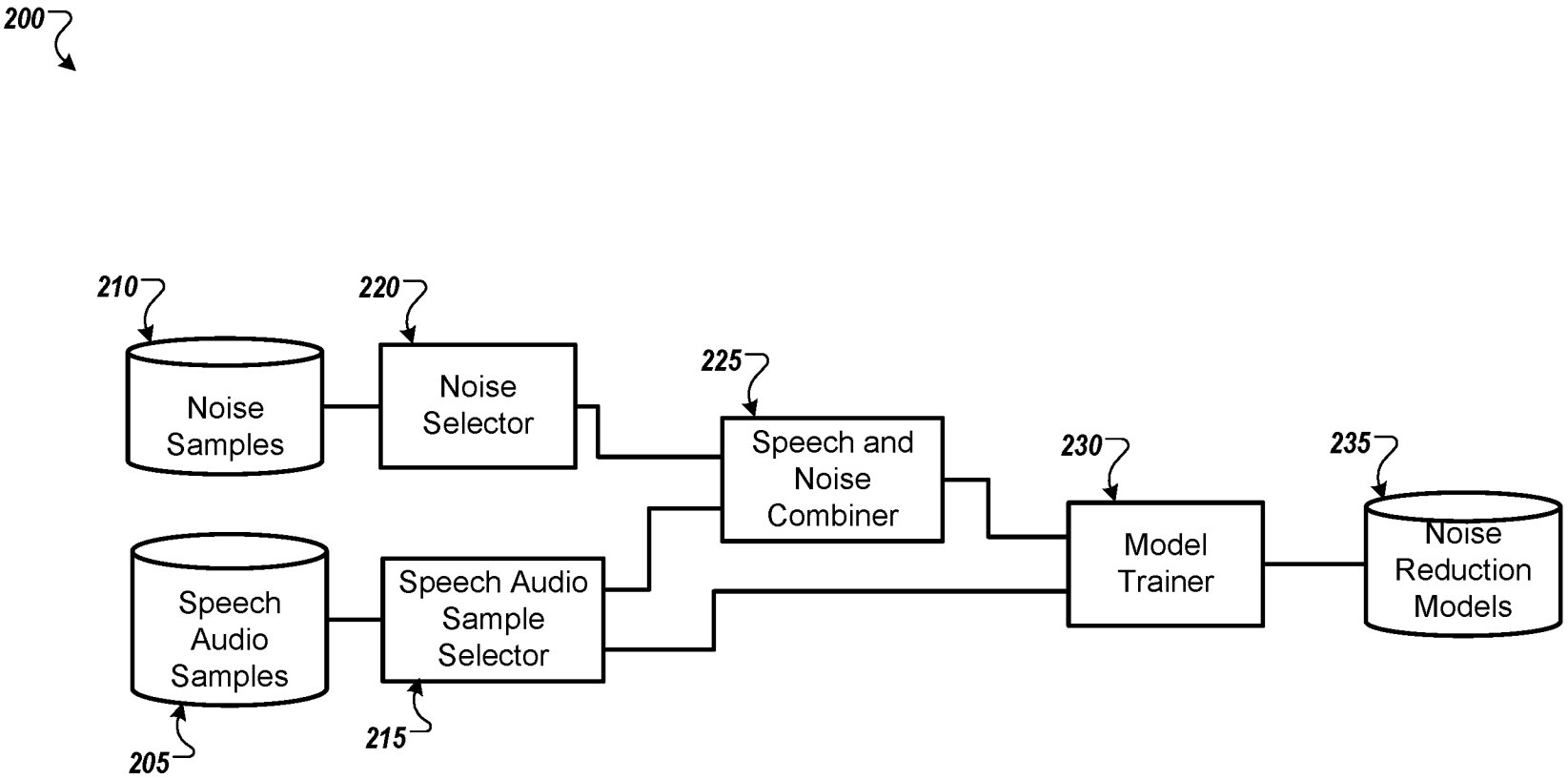
FIG. 2 illustrates an example system for training noise reduction models for use in an audio conference system.

FIG. 2 illustrates an example system 200 for training noise reduction models for use in an audio conference system. The system 200 may be included in the audio conference device 112 and/or the audio conference device 114 of FIG. 1 or included in a separate computing device. The separate computing device may be any type of computing device that is capable of processing audio samples. The system 200 may train noise reduction models for use in the audio conference system 100 of FIG. 1.

The system 100 includes speech audio samples 205. The speech audio samples 205 include clean samples of different speakers speaking different phrases. For example, one audio sample may be a woman speaking "can I make an appointment for tomorrow" without any background noise. Another audio sample may be a man speaking "please give me directions to the store" without any background noise. In some implementations, the speech audio samples 205 may include an amount of background noise that is below a certain threshold because it may be difficult to obtain speech audio samples that do not include any background noise. In some implementations, the speech audio samples may be generated by various speech synthesizers with different voices. The speech audio samples 205 may include only spoken audio samples, only speech synthesis audio samples, or a mix of both spoken audio samples and speech synthesis audio samples.

The system 100 includes noise samples 210. The noise samples 210 may include samples of several different types of noise. The noise samples may include stationary noise and/or non-stationary noise. For example, the noise samples 210 may include street noise samples, road noise samples, cocktail noise samples, office noise samples, etc. The noise samples 210 may be collected through a microphone or may be generated by a noise synthesizer.

The noise selector 220 may be configured to select a noise sample from the noise samples 210. The noise selector 220 may be configured to cycle through the different noise samples and track those noise samples have already been selected. The noise selector 220 provides the selected noise sample to the speech and noise combiner 225. In some implementations, the noise selector 220 provides one noise sample to the speech and noise combiner 225. In some implementations, the noise selector 220 provides more than one noise sample to the speech and noise combiner 225 such as one office noise sample and one street noise sample or two office noise samples.

The speech audio sample selector 215 may operate similarly to the noise selector. The speech audio sample selector 215 may be configured to cycle through the different speech audio samples and track those speech audio samples that have already been selected. The speech audio sample selector 215 provides the selected speech audio sample to the speech and noise combiner 225 and to the model trailer 230. In some implementations, the speech audio sample selector 215 provides one speech audio sample to the speech and noise combiner 225 and the model trailer 230. In some implementations, the speech audio sample selector 215 provides either one or two speech audio samples to the speech and noise combiner 225 and the model trailer 230 such as one speech sample of "what time is the game on" and another speech sample of "all our tables are booked for that time" or only speech sample "what time is the game on."

The speech and noise combiner 225 combines the one or more noise samples received from the noise selector 220 and the one or more speech audio samples received from the speech audio sample selector 215. The speech and noise combiner 225 combines the samples by overlapping them and summing the samples. In this sense, more than one speech audio samples will overlap to imitate more than one person talking at the same time. In instances where the received samples are not all the same length in time, the speech and noise combiner 225 may extend an audio sample by repeating the sample until the needed time length is reached. For example, if one speech audio samples is of "call mom" and another speech sample is of "can I make a reservation for tomorrow evening," then the speech and noise combiner 225 may concatenate multiple samples of "call mom" to reach the length of "can I make a reservation for tomorrow evening." In instances where the speech and noise combiner 225 combines multiple speech audio files, the speech and noise combiner 225 outputs the combined speech audio with noise added and the combined speech audio without noise added.

In some implementations, the noise added by the speech and noise combiner 225 may include an echo. In this instance, the speech and noise combiner 225 may add some noise such as air vent noise to a speech audio sample as well as included an echo of the same speech audio sample. The speech and noise combiner 225 may also add an echo for other samples that include more than one speaker. In this instance, the speech and noise combiner 225 may add an echo for one of the speech samples, both of the speech samples, or alternating echoes for the speech samples.

The model trainer 230 may use machine learning to train a model. The model trainer 230 may train the model to receive an audio sample that includes speech and noise and output an audio sample that includes speech and reduced noise. To train the model, the model trainer 230 uses pairs of audio samples that each include a speech audio sample received from the speech audio sample selector 215 and the sample received form the speech and noise combiner 225 that adds noise to the speech audio sample.

The model trainer 230 trains multiple models each using a different group of audio samples. The model trainer 230 trains a single speaker model using speech audio samples that each include audio from a single speaker and speech and noise samples that are the same speech audio samples with noise added. The model trainer trains a one/two speaker model using speech audio samples that each include audio from both one speaker and two speakers speaking simultaneously and speech and noise samples that are the same combined one or two speaker samples with noise added. The speech and noise combiner 225 may generate these two speaker samples by adding speech audio from two different speech audio samples from different speakers. The model trainer 230 may train additional models for three speaker models and other number of speaker models using similar techniques.

The model trainer 230 stores the trained models in the noise reduction models 235. The noise reduction models 235 indicates the number of simultaneous speakers included in the training samples for each model.

Figure 3:
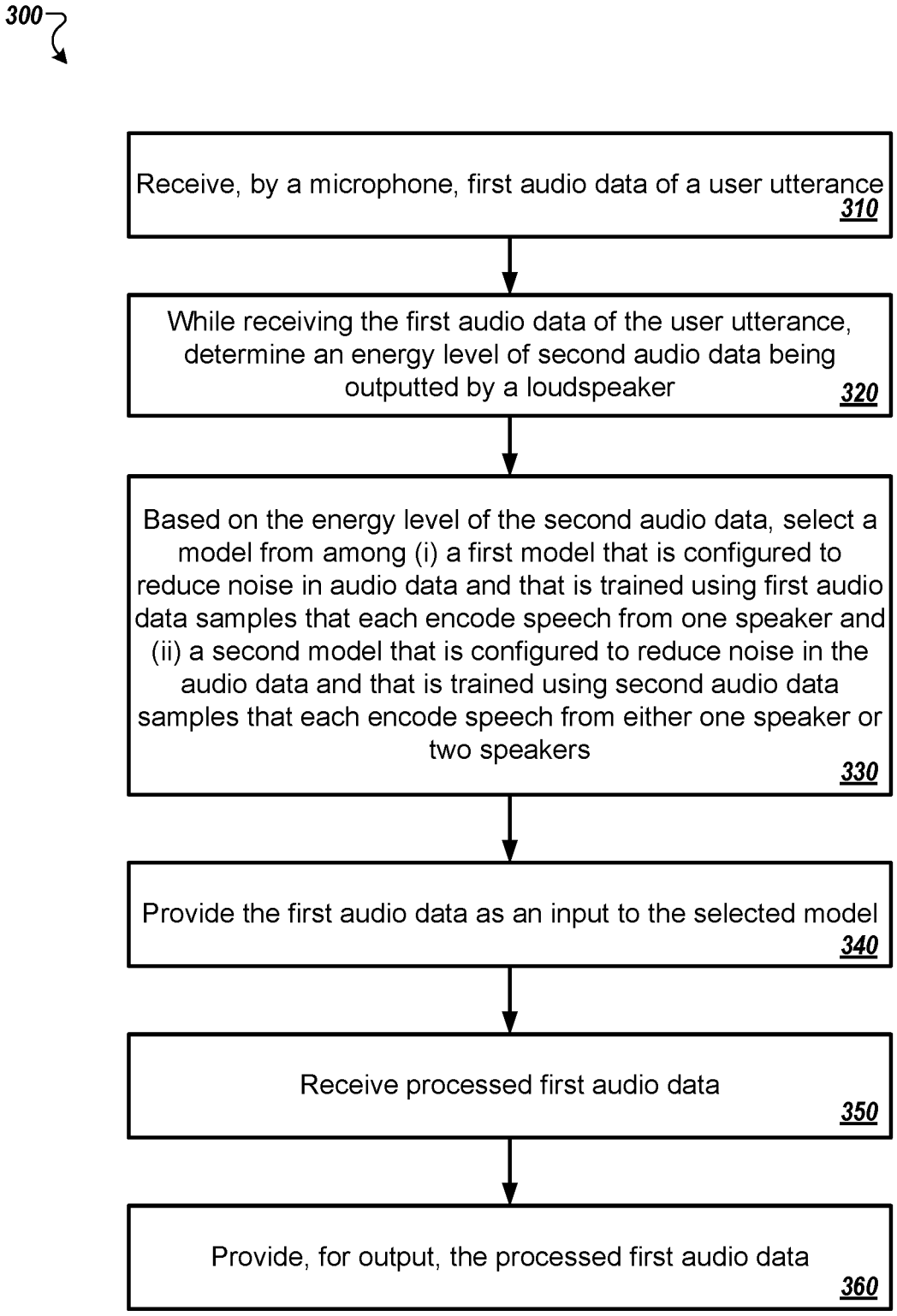
FIG. 3 is a flowchart of an example process for applying different noise reduction models to detected audio depending on the energy level of the audio being output by a loudspeaker.

FIG. 3 is a flowchart of an example process 300 for applying different noise reduction models to incoming audio depending on the energy level of the audio being output by a loudspeaker. In general, the process 300 receives audio data during an audio conference. The process 300 selects a noise reduction model depending on the energy of audio being output by a loudspeaker, such as audio received from another computing system communicating in the audio conference. The noise reduction model is applied to the audio data before transmitting the audio data to the other computing system participating in the audio conference. The process 300 will be described as being performed by a computer system comprising one or more computers, for example, the system 100 of FIG. 1 and/or the system 200 of FIG. 2.

The system receives first audio data of a user utterance detected by a microphone of the system (310). The system includes the microphone and a loudspeaker. In some implementations, the microphone detects audio output by the loudspeaker as well as the audio of the user utterance.

While receiving the first audio data, the system determines an energy level of second audio data being outputted by the loudspeaker (320). The energy level may be the amplitude of the second audio data. In some implementations, the system may average the energy level of the second audio data over a period of time. In some implementations, the system may determine the energy level at a particular interval.

The system, based on the energy level of the second audio data, selects a model from among (i) a first model that is configured to reduce noise in the audio data and that is trained using first audio data samples that each encode speech from one speaker and (ii) a second model that is configured to reduce noise in the audio data and that is trained using second audio data samples that each encode speech from either one speaker or two speakers (330). In some implementations, the system may compare the energy level to a threshold energy level. The system may select the first model if the energy level is above the threshold energy level and the second model if the energy level is below the threshold energy level.

In some implementations, the system generates the training data to train the first model. The training data may include audio samples that encode speech from several speakers and noise samples. Each training sample may include speech from one speaker. The system combines the noise samples and speech samples. The system trains the first model using machine learning and the speech samples and the combined speech and noise samples.

In some implementations, the system generates the training data to train the second model. The training data may include speech audio samples from several speakers and noise samples. The system combines noise samples and either one or two speech samples. The system also combines the same groups of either one or two speech samples. The system trains the second model using machine learning and the combined speech samples and the combined speech and noise samples. In some implementations, the system combines the noise and the one or two speech samples by summing the noise and the one or two speech samples in the time domain. In some implementations, the system combines the two speech samples by summing the speech samples in the time domain. This summing may be in contrast to combining audio samples by concatenating them.

The system uses the energy of the second audio data output by the loudspeaker to select between the first model and the second model as a measure of the likelihood of the second audio data including speech, such as a person speaking into a microphone of another system communicating in the audio conference. In some implementations, the system may be configured such that the system selects the first model if the energy level of the audio data output by the loudspeaker is below the energy level threshold and selects the second model if the energy level of the audio data output by the loudspeaker is above the energy level threshold.

The system provides the first audio data as an input to the selected model (340) and receives, from the selected model, processed first audio data (350). In some implementations, the system may apply an echo canceller or echo suppressor to the first audio data before providing the first audio data to the selected model. The system provides, for output, the processed first audio data (360). For example, the system may transmit the processed first audio data to another audio conference device.

In some implementations, the system may use a static threshold energy level. The static threshold energy level may be set based on the type of device that the system is. In some implementations, the static threshold energy level may be set during configuration of the system. For example, an installer may run a configuration setting when installing the system so that the system can detect a baseline noise level. The installation process may also include the system outputting audio samples that include speech through the loudspeaker and other audio samples that do not include speech. The audio samples may be collected from different audio conference systems in different settings such as a closed conference room and an open office. The system may determine an appropriate threshold energy level based on the energy levels of audio data that include speech of one or more speakers and audio data that does not include speech. For example, the system may determine the arithmetic or geometric mean of the energy levels of the audio data that includes speech and the arithmetic or geometric mean of the audio data that does not include speech. The threshold energy level may be the arithmetic or geometric mean of (i) the arithmetic or geometric mean of the energy levels of the audio data that includes speech and (ii) the arithmetic or geometric mean of the audio data that does not include speech.

In some implementations, the system may use a dynamic threshold energy level. For example, the system may include a speech recognizer that generates a transcription of audio received using microphones other audio conference systems participating in the audio conference system. If the system determines that the transcriptions match phases that request that a speaker repeat what the speaker said and/or that the transcriptions include repeated phrases, the system may adjust the threshold energy level, then the system may attempt to increase or decrease the threshold energy level. If the system continues to determine that the transcriptions match phases that request that a speaker repeat what the speaker said and/or that the transcriptions include repeated phrases, then the system may increase or decrease the threshold energy level.

Figure 4:
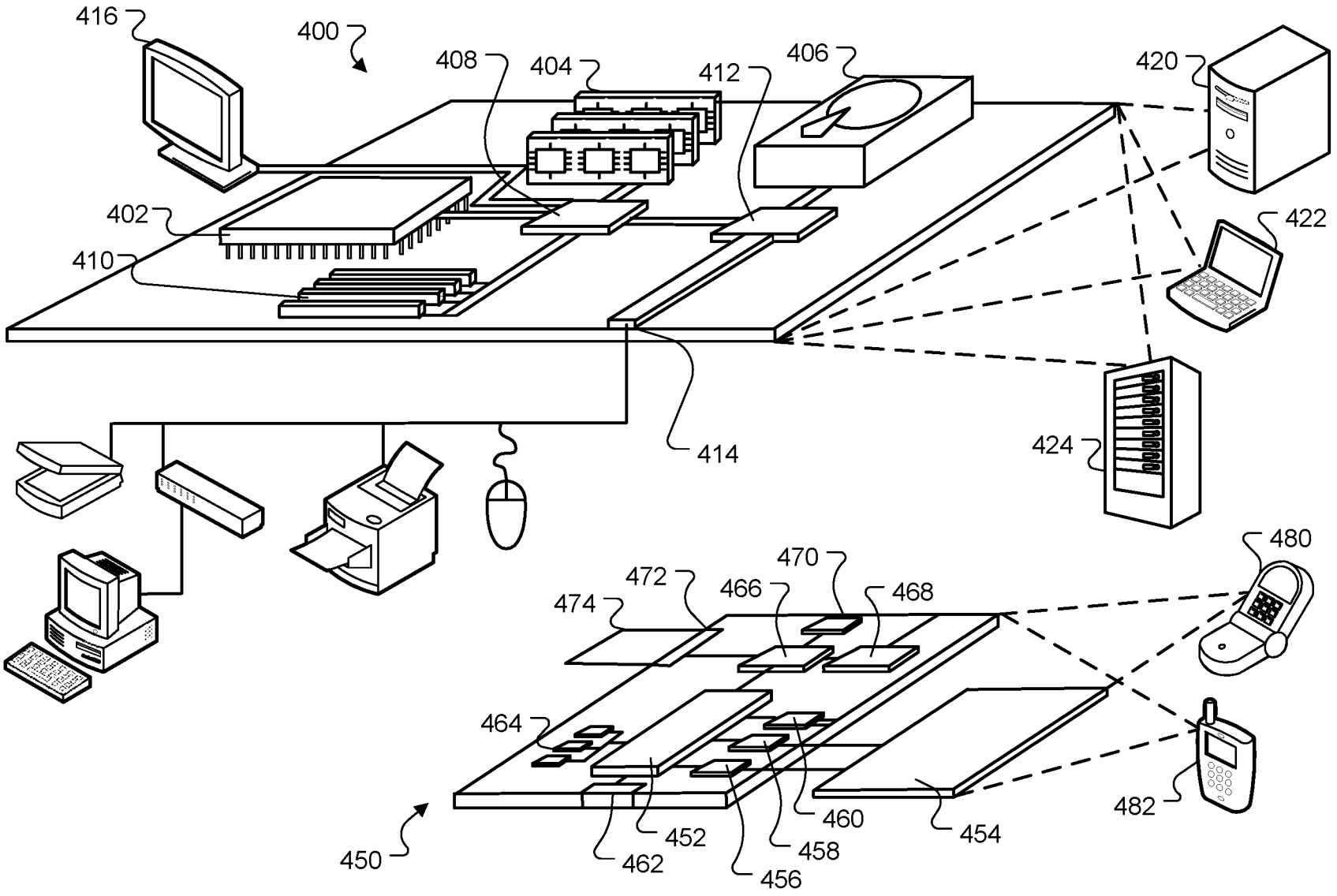
FIG. 4 is an example of a computing device and a mobile computing device.

FIG. 4 shows an example of a computing device 400 and a mobile computing device 450 that can be used to implement the techniques described here. The computing device 400 is intended to represent various forms of digital computers, such as laptops, desktops, workstations, personal digital assistants, servers, blade servers, mainframes, and other appropriate computers. The mobile computing device 450 is intended to represent various forms of mobile devices, such as personal digital assistants, cellular telephones, smart-phones, and other similar computing devices. The components shown here, their connections and relationships, and their functions, are meant to be examples only, and are not meant to be limiting.

The computing device 400 includes a processor 402, a memory 404, a storage device 406, a high-speed interface 408 connecting to the memory 404 and multiple high-speed expansion ports 410, and a low-speed interface 412 connecting to a low-speed expansion port 414 and the storage device 406. Each of the processor 402, the memory 404, the storage device 406, the high-speed interface 408, the high-speed expansion ports 410, and the low-speed interface 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as a display 416 coupled to the high-speed interface 408. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 404 stores information within the computing device 400. In some implementations, the memory 404 is a volatile memory unit or units. In some implementations, the memory 404 is a non-volatile memory unit or units. The memory 404 may also be another form of computer-readable medium, such as a magnetic or optical disk.

The storage device 406 is capable of providing mass storage for the computing device 400. In some implementations, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 402), perform one or more methods, such as those described above. The instructions can also be stored by one or more storage devices such as computer- or machine-readable mediums (for example, the memory 404, the storage device 406, or memory on the processor 402).

The high-speed interface 408 manages bandwidth-intensive operations for the computing device 400, while the low-speed interface 412 manages lower bandwidth-intensive operations. Such allocation of functions is an example only. In some implementations, the high-speed interface 408 is coupled to the memory 404, the display 416 (e.g., through a graphics processor or accelerator), and to the high-speed expansion ports 410, which may accept various expansion cards (not shown). In the implementation, the low-speed interface 412 is coupled to the storage device 406 and the low-speed expansion port 414. The low-speed expansion port 414, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. In addition, it may be implemented in a personal computer such as a laptop computer 422. It may also be implemented as part of a rack server system 424. Alternatively, components from the computing device 400 may be combined with other components in a mobile device (not shown), such as a mobile computing device 450. Each of such devices may contain one or more of the computing device 400 and the mobile computing device 450, and an entire system may be made up of multiple computing devices communicating with each other.

The mobile computing device 450 includes a processor 452, a memory 464, an input/output device such as a display 454, a communication interface 466, and a transceiver 468, among other components. The mobile computing device 450 may also be provided with a storage device, such as a micro-drive or other device, to provide additional storage. Each of the processor 452, the memory 464, the display 454, the communication interface 466, and the transceiver 468, are interconnected using various buses, and several of the components may be mounted on a common motherboard or in other manners as appropriate.

The processor 452 can execute instructions within the mobile computing device 450, including instructions stored in the memory 464. The processor 452 may be implemented as a chipset of chips that include separate and multiple analog and digital processors. The processor 452 may provide, for example, for coordination of the other components of the mobile computing device 450, such as control of user interfaces, applications run by the mobile computing device 450, and wireless communication by the mobile computing device 450.

The processor 452 may communicate with a user through a control interface 458 and a display interface 456 coupled to the display 454. The display 454 may be, for example, a TFT (Thin-Film-Transistor Liquid Crystal Display) display or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may provide communication with the processor 452, so as to enable near area communication of the mobile computing device 450 with other devices. The external interface 462 may provide, for example, for wired communication in some implementations, or for wireless communication in other implementations, and multiple interfaces may also be used.

The memory 464 stores information within the mobile computing device 450. The memory 464 can be implemented as one or more of a computer-readable medium or media, a volatile memory unit or units, or a non-volatile memory unit or units. An expansion memory 474 may also be provided and connected to the mobile computing device 450 through an expansion interface 472, which may include, for example, a SIMM (Single In Line Memory Module) card interface. The expansion memory 474 may provide extra storage space for the mobile computing device 450, or may also store applications or other information for the mobile computing device 450. Specifically, the expansion memory 474 may include instructions to carry out or supplement the processes described above, and may include secure information also. Thus, for example, the expansion memory 474 may be provide as a security module for the mobile computing device 450, and may be programmed with instructions that permit secure use of the mobile computing device 450. In addition, secure applications may be provided via the SIMM cards, along with additional information, such as placing identifying information on the SIMM card in a non-hackable manner.

The memory may include, for example, flash memory and/or NVRAM memory (non-volatile random access memory), as discussed below. In some implementations, instructions are stored in an information carrier. that the instructions, when executed by one or more processing devices (for example, processor 452), perform one or more methods, such as those described above. The instructions can also be stored by one or more storage devices, such as one or more computer- or machine-readable mediums (for example, the memory 464, the expansion memory 474, or memory on the processor 452). In some implementations, the instructions can be received in a propagated signal, for example, over the transceiver 468 or the external interface 462.

The mobile computing device 450 may communicate wirelessly through the communication interface 466, which may include digital signal processing circuitry where necessary. The communication interface 466 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 468 using a radio-frequency. In addition, short-range communication may occur, such as using a Bluetooth, WiFi, or other such transceiver (not shown). In addition, a GPS (Global Positioning System) receiver module 470 may provide additional navigation- and location-related wireless data to the mobile computing device 450, which may be used as appropriate by applications running on the mobile computing device 450.

The mobile computing device 450 may also communicate audibly using an audio codec 460, which may receive spoken information from a user and convert it to usable digital information. The audio codec 460 may likewise generate audible sound for a user, such as through a speaker, e.g., in a handset of the mobile computing device 450. Such sound may include sound from voice telephone calls, may include recorded sound (e.g., voice messages, music files, etc.) and may also include sound generated by applications operating on the mobile computing device 450.

The mobile computing device 450 may be implemented in a number of different forms, as shown in the figure. For example, it may be implemented as a cellular telephone 480. It may also be implemented as part of a smart-phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet. In some implementations, the systems and techniques described here can be implemented on an embedded system where speech recognition and other processing is performed directly on the device.

The computing system can include clients and servers. A client and server are generally remote from each other and typically interact through a communication network. The relationship of client and server arises by virtue of computer programs running on the respective computers and having a client-server relationship to each other.

Although a few implementations have been described in detail above, other modifications are possible. For example, while a client application is described as accessing the delegate(s), in other implementations the delegate(s) may be employed by other applications implemented by one or more processors, such as an application executing on one or more servers. In addition, the logic flows depicted in the figures do not require the particular order shown, or sequential order, to achieve desirable results. In addition, other actions may be provided, or actions may be eliminated, from the described flows, and other components may be added to, or removed from, the described systems. Accordingly, other implementations are within the scope of the following claims.

What is claimed is:

1. A computer-implemented method comprising:

receiving, by a computing device that has an associated microphone and loudspeaker, first audio data of a user utterance of a participant that is at a location of the computing device and using the computing device, the first audio data being generated using the microphone;

while receiving the first audio data of the user utterance, determining, by the computing device, an energy level of second audio data being outputted by the loudspeaker of the computing device, the second audio data being of a user utterance of a participant at a remote location that is different from the location of the computer device and generated using a microphone of a different computer device at the remote location;

comparing an audio energy threshold to the determined energy level;

determining, based on the comparison of the audio energy threshold to the determined energy level, whether a double-talk situation exists, wherein the double-talk situation exists when first audio data of the user utterance is being received while second audio data is being outputted by the loudspeaker, indicating the participants at different locations utilizing the computer devices are speaking simultaneously;

based on the determination of whether a double-talk situation exists, selecting, by the computing device, a model from among (i) a first model that is configured to reduce noise in audio data that includes speech from one speaker and that is trained using first training audio data samples that each encode speech from one speaker and (ii) a second model that is configured to reduce noise in the audio data that includes speech from more than one speaker and that is trained using second training audio data samples that each encode speech from either one speaker or two speakers, wherein the first model is selected when a double-talk situation is determined to exist, and the second model is selected when a double-talk situation is not determined to exist;

providing, by the computing device, the first audio data as an input to the selected model;

receiving, by the computing device and from the selected model, processed first audio data; and providing, for output by the computing device, the processed first audio data.

2. The method of claim 1, comprising:

receiving, by the computing device, audio data of a first utterance spoken by a first speaker and audio data of a second utterance spoken by a second speaker;

generating, by the computing device, combined audio data by combining the audio data of the first utterance and the audio data of the second utterance;

generating, by the computing device, noisy audio data by combining the combined audio data with noise; and training, by the computing device and using machine learning, the second model using the combined audio data and the noisy audio data.

3. The method of claim 2, wherein combining the audio data of the first utterance and the audio data of the second utterance comprises overlapping the audio data of the first utterance and the audio data of the second utterance in the time domain and summing the audio data of the first utterance and the audio data of the second utterance.

4. The method of claim 1, comprising:

before providing the first audio data as an input to the selected model, providing, by the computing device, the first audio data as an input to an echo canceller that is configured to reduce echo in the first audio data.

5. The method of claim 1, comprising:

receiving, by the computing device, audio data of an utterance spoken by a speaker;

generating, by the computing device, noisy audio data by combining the audio data of the utterance with noise; and training, by the computing device and using machine learning, the first model using the audio data of the utterance and the noisy audio data.

6. The method of claim 1, wherein the second model is trained using second audio data samples that each encode speech from either two simultaneous speakers or one speaker.

7. The method of claim 1, comprising:

comparing, by the computing device, the energy level of the second audio data to a threshold energy level; and based on comparing the energy level of the second audio data to the threshold energy level, determining, by the computing device, that the energy level of the second audio data does not satisfy the threshold energy level, wherein selecting the model comprises selecting the second model based on determining that the energy level of the second audio data does not satisfy the threshold energy level.

8. The method of claim 1, comprising:

comparing, by the computing device, the energy level of the second audio data to a threshold energy level; and based on comparing the energy level of the second audio data to the threshold energy level, determining, by the computing device, that the energy level of the second audio data satisfies the threshold energy level, wherein selecting the model comprises selecting the first model based on determining that the energy level of the second audio data satisfies the threshold energy level.

9. The method of claim 1, wherein the microphone of the computing device is configured to detect audio output by the loudspeaker of the computing device.

10. The method of claim 1, wherein the computing device is communicating with another computing device during an audio conference.

11. The method of claim 1, wherein the computing device is communicating with another computing device during a video conference.

12. A computing device comprising:

one or more processors; and one or more storage devices storing instructions that are operable, when executed by the one or more processors, to cause the computing device to perform the operations comprising:

receiving, by a computing device that has an associated microphone and loudspeaker, first audio data of a user utterance of a participant that is at a location of the computing device and using the computing device, the first audio data being generated using the microphone;

while receiving the first audio data of the user utterance, determining, by the computing device, an energy level of second audio data being outputted by the loudspeaker of the computing device, the second audio data being of a user utterance of a participant at a remote location that is different from the location of the computer device and generated using a microphone of a different computer device at the remote location;

comparing an audio energy threshold to the determined energy level;

determining, based on the comparison of the audio energy threshold to the determined energy level, whether a double-talk situation exists, wherein the double-talk situation exists when first audio data of the user utterance is being received while second audio data is being outputted by the loudspeaker, indicating the participants at different locations utilizing the computer devices are speaking simultaneously;

based on the determination of whether a double-talk situation exists, selecting, by the computing device, a model from among (i) a first model that is configured to reduce noise in audio data that includes speech from one speaker and that is trained using first training audio data samples that each encode speech from one speaker and (ii) a second model that is configured to reduce noise in the audio data that includes speech from more than one speaker and that is trained using second training audio data samples that each encode speech from either one speaker or two speakers, wherein the first model is selected when a double-talk situation is determined to exist, and the second model is selected when a double-talk situation is not determined to exist;

providing, by the computing device, the first audio data as an input to the selected model;

receiving, by the computing device and from the selected model, processed first audio data; and providing, for output by the computing device, the processed first audio data.

13. The system of claim 12, wherein the operations comprise:

receiving, by the computing device, audio data of a first utterance spoken by a first speaker and audio data of a second utterance spoken by a second speaker;

generating, by the computing device, combined audio data by combining the audio data of the first utterance and the audio data of the second utterance;

generating, by the computing device, noisy audio data by combining the combined audio data with noise; and training, by the computing device and using machine learning, the second model using the combined audio data and the noisy audio data.

14. The system of claim 12, wherein the operations comprise:

before providing the first audio data as an input to the selected model, providing, by the computing device, the first audio data as an input to an echo canceller that is configured to reduce echo in the first audio data.

15. The system of claim 12, wherein the operations comprise:

receiving, by the computing device, audio data of an utterance spoken by a speaker;

generating, by the computing device, noisy audio data by combining the audio data of the utterance with noise; and training, by the computing device and using machine learning, the first model using the audio data of the utterance and the noisy audio data.

16. The system of claim 12, wherein the second model is trained using second audio data samples that each encode speech from either two simultaneous speakers or one speaker.

17. The system of claim 12, wherein the operations comprise:

comparing, by the computing device, the energy level of the second audio data to a threshold energy level; and based on comparing the energy level of the second audio data to the threshold energy level, determining, by the computing device, that the energy level of the second audio data does not satisfy the threshold energy level, wherein selecting the model comprises selecting the second model based on determining that the energy level of the second audio data does not satisfy the threshold energy level.

18. The system of claim 12, wherein the operations comprise:

comparing, by the computing device, the energy level of the second audio data to a threshold energy level; and based on comparing the energy level of the second audio data to the threshold energy level, determining, by the computing device, that the energy level of the second audio data satisfies the threshold energy level, wherein selecting the model comprises selecting the first model based on determining that the energy level of the second audio data satisfies the threshold energy level.

19. The system of claim 12, wherein the microphone of the computing device is configured to detect audio output by the loudspeaker of the computing device.

20. One or more non-transitory computer-readable media storing software comprising instructions executable by one or more processors of a computing device which, upon such execution, cause the computing device to perform the operations comprising:

receiving, by a computing device that has an associated microphone and loudspeaker, first audio data of a user utterance of a participant that is at a location of the computing device and using the computing device, the first audio data being generated using the microphone;

while receiving the first audio data of the user utterance, determining, by the computing device, an energy level of second audio data being outputted by the loudspeaker of the computing device, the second audio data being of a user utterance of a participant at a remote location that is different from the location of the computer device and generated using a microphone of a different computer device at the remote location;

comparing an audio energy threshold to the determined energy level;

determining, based on the comparison of the audio energy threshold to the determined energy level, whether a double-talk situation exists, wherein the double-talk situation exists when first audio data of the user utterance is being received while second audio data is being outputted by the loudspeaker, indicating the participants at different locations utilizing the computer devices are speaking simultaneously;

based on the determination of whether a double-talk situation exists, selecting, by the computing device, a model from among (i) a first model that is configured to reduce noise in audio data that includes speech from one speaker and that is trained using first training audio data samples that each encode speech from one speaker and (ii) a second model that is configured to reduce noise in the audio data that includes speech from more than one speaker and that is trained using second training audio data samples that each encode speech from either one speaker or two speakers, wherein the first model is selected when a double-talk situation is determined to exist, and the second model is selected when a double-talk situation is not determined to exist;

providing, by the computing device, the first audio data as an input to the selected model;

receiving, by the computing device and from the selected model, processed first audio data; and providing, for output by the computing device, the processed first audio data.

* * * * *